United States Patent [19]

Le Doux

[11] 4,008,465

[45] Feb. 15, 1977

[54] KEYLESS ANTI-THEFT ENTRY SYSTEM

[76] Inventor: Herbert C. Le Doux, 136 Seaman Ave., New York, N.Y. 10034

[22] Filed: Mar. 29, 1976

[21] Appl. No.: 671,386

[52] U.S. Cl. ..... 340/274 C; 307/40; 361/171

[51] Int. Cl.[2] ..... G08B 13/08

[58] Field of Search ..... 340/274 C, 164 A, 164 R; 317/134; 307/40, 115

[56] References Cited

UNITED STATES PATENTS

| | | | |
|---|---|---|---|
| 2,606,237 | 8/1952 | Chase | 340/274 C |
| 3,538,501 | 11/1970 | Nance | 340/274 C |
| 3,587,484 | 6/1971 | Munton | 317/134 |
| 3,600,637 | 8/1971 | Bergkvist | 340/164 A |

*Primary Examiner*—Glen R. Swann, III
*Attorney, Agent, or Firm*—Richard L. Miller

[57] ABSTRACT

An anti-theft system for guarding a premises and providing entry thereto, includes a selector switch device which has both a plurality of buttons and a rotary dial with a plurality of numbered positions. The rotary dial is preset for a specific number corresponding to each button. The buttons are arranged to be depressed in a predetermined sequence. The dial must be positioned at the preset number and the corresponding button depressed in order to disengage the alarm. For each button, the proper positioning of the dial followed by the depressing of that button energizes the next button in the sequence. When the final dial position and corresponding button is depressed, the window, door, or the like, will be opened. The wrong sequence of buttons or the wrong position on the dial for its corresponding button, will immediately cause the alarm to be reset. The selector switch device can be located exterior of the premises for entry into the premises, and a number of similar selector switch devices can be located interior of the building to open the general premises, or to open particular windows, doors or the like, within the premises.

10 Claims, 6 Drawing Figures

KEYLESS ANTI-THEFT ENTRY SYSTEM

BACKGROUND OF THE INVENTION

This invention relates to an anti-theft system, and more particularly to an anti-theft device which is also used to obtain authorized entry and which operates without the use of a key.

Numerous burglary prevention systems are presently available for guarding a premises such as a house, building or the like. Many of these systems operate under control of a key which is maintained by the authorized user. The key is utilized to arm the system as well as to disarm the system. Entry into the premises can only be achieved by disarming the burglar alarm system with the prescribed key. After the burglar alarm is disarmed, a separate key must be used to obtain entry into the premises. However, as is well known, it is relatively easy to obtain a counterfeit key to fit the burglar system lock as well as the regular lock. Once such a counterfeit key is made, the burglar alarm can be disarmed and unauthorized entry to the premises can be obtained.

Other types of burglar alarms utilize a combination lock which may use a keypunch type of entry device, wherein numbers are depressed in accordance with a predetermined sequence to obtain entry into the premises. However, such systems have a limited number of possible combinations due to the limited number of buttons which can be placed on the device. Increasing the number of buttons also increases the complexity of the circuitry and the cost involved. As a result, most of these burglar alarm systems utilize simple combinations with relatively few number of possible combination of numbers. Furthermore, even after the combination lock is opened, a regular key type lock is still utilized to obtain authorized entry into the premises.

It is therefore an object of the present invention to provide an anti-theft system which avoids the aforementioned problems of prior art devices.

A further object of the present invention is to provide an anti-theft system which will provide maximum security to homes, buildings and the like and eliminate the necessity of utilizing a key operated locking device for entry and exit into the premises.

Yet another object of the present invention is to provide an anti-theft system which utilizes a selector switch having a combination of buttons for depression as well as a rotary dial with numbered positions; wherein the combination is determined by the selection of the proper sequence of buttons in conjunction with the selection of a preset position on the rotary dial for each button depressed.

Yet a further object of the present invention is to provide an anti-theft system which includes a selector switch device exterior of the premises as well as a similar device interior of the premises, both of the devices being coupled together.

Yet another object of the present invention is to provide an anti-theft system which utilizes a unique selector switch device for obtaining entry into the premises.

A further object of the present invention is to provide an anti-theft system which requires carrying out a prescribed sequence of steps to obtain entry, wherein each step provides an energy source for the next step, and wherein an error on any one of the steps makes it impossible to carry out the next step and also necessary to repeat the entire sequence of correct steps.

Another object of the present invention is to provide an anti-theft system which provides an indication when the system is guarding the premises as well as a separate indication when the premises can be used for authorized entry and exit.

A still further object of the present invention is to provide an anti-theft system having a first guarding position which only permits entry by opening of a prescribed combination and which has a second monitoring position which only permits entry into the premises by the use of an additional switching device.

Another object of the present invention is to provide an anti-theft system which is rugged in construction, inexpensive to manufacture and install, easy to manipulate, and efficient and reliable in operation.

These and other objects, features and advantages of the invention, will, in part, be pointed out with particularity, and will, in part, become obvious from the following more detailed description of the invention, taken in conjunction with the accompanying drawings, which form an integral part thereof.

SUMMARY OF THE INVENTION

Briefly, the invention comprises an anti-theft system for guarding a premises and providing entry thereto, and includes a selector switch means which includes a plurality of sections. Each of the sections of the selector switch means has an input terminal, an intermediate terminal and an output terminal. A rotary dial means is coupled between the intermediate terminal and the output terminal in each section. The rotary dial means has a plurality of positions and is capable of being preset to interconnect the intermediate terminal with the output terminal when dialed to a particular position. Button switch means are coupled between the input terminal and the intermediate terminal of each section. The anti-theft system further includes a plurality of latching means, each latching means respectively associated with a section of the selector switch means. Each of the latching means includes a relay coil coupled to the output terminal of its respective section of the selector switch means which is energized when the button switch means of the respective section is closed as well as the preset position being dialed on the respective rotary dial means. Each of the latching means also includes a relay switch which is activated by the relay coil to close from a normal position to an active position. A reset means is also included in each latching means, which is coupled to the output terminal of its respective section of the selector switch means and is energized when the button switch means of that respective section is closed and its respective rotary dial means is set onto any position other than the preset position. The reset means serves to return the relay switch back to its normal position. The active position of the relay switches of each of the latching means, with the exclusion of one relay switch is interconnected to the input terminal of a different section of the selector switch means, in accordance with a predetermined sequence. An energy supply means is coupled to each of the relay switches as well as being coupled to the input terminal of the remaining section which is not interconnected to any of the active positions of a relay switch. An alarm circuit means is coupled to the normal position of the excluded relay switch. When the button switch means are depressed in accordance with the predetermined sequence, and as each button is depressed and its respective rotary dial means has been rotated to its corresponding preset position, the alarm circuit will be disengaged.

A solenoid is utilized to hold closed the various members, such as a window, door, or the like. To retract the solenoid, a control switch can be connected in series with the solenoid and coupled to the active position of the excluded relay switch, whereby as that relay switch disengages the alarm circuit, it will activate the control switch permitting the solenoid to be retracted. Alternately, an additional final section can be included on the selector switch means and interconnected with the active terminal of the excluded relay switch, such that the solenoid is retracted by the depressing of the button in the final section in conjunction with the setting of the rotary dial of the final section to its preset position.

BRIEF DESCRIPTION OF THE DRAWING

In the drawings.

In the various figures of the drawing, like reference characters designate like parts.

DESCRIPTION OF THE PREFERRED EMBODIMENT

Figure 1:
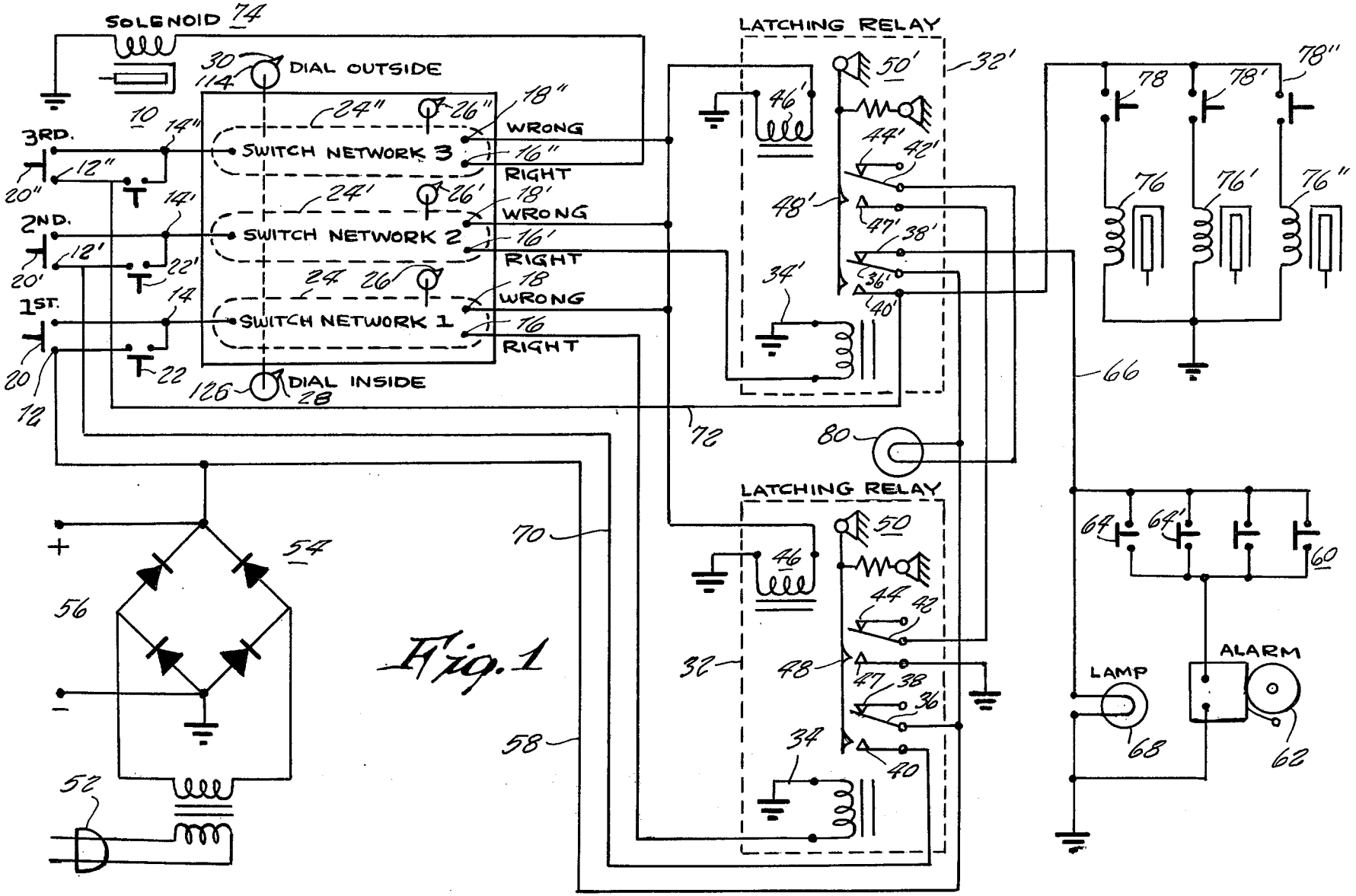
FIG. 1 is a schematic circuit diagram of an embodiment of the present invention.

Referring now to FIG. 1 there is shown an embodiment of the present invention. The anti-theft device is armed and disarmed by means of a selector switch means shown generally at 10 and including a plurality of sections, indicated as first, second and third. Each of the sections includes an input terminal 12, and intermediate terminal 14 and a "right" output terminal 16 as well as a "wrong" output terminal 18. A button type switch 20 is utilized to interconnect the input terminal 12 with the intermediate terminal 14. A second button type switch 22 is also available for interconnecting these last two mentioned terminals. The intermediate terminal 14 is interconnected to the output terminals 16, 18, by means of a switch network 24 which includes a plurality of positions which can be selected by means of an inside dial 28 or an outside dial 30. A particular one of the positions can be preset by means of the dial 26. When the inside dial 28 or the outside dial 30 is switch to the position preselected by dial 26, the switch network will interconnect intermediate terminal 14 with the "right" output terminal 16. For all other positions, the switch network 24 will interconnect the intermediate terminal 14 with the "wrong" output terminal 18. A latching relay, shown generally at 32, is coupled to the output terminals 16, 18 of the switch network 24. The right output terminal 16 is connected to a first relay coil 34 whose other end is coupled to ground. Relay coil 34 interacts with relay switch 36 having a normal position 38 which is unconnected, and an active position 40. Relay coil 34 also controls the operation of another relay switch 42 having a normal position 44 which is unconnected, and an active position 47. The wrong output terminal 18 of the switch network 24 is interconnected to a relay coil 46 whose other end is coupled to ground and which controls a resetting bar 48 which is normally held by the spring mechanism 50 to latch the relay switches 36, 42 into their active positions. When relay coil 46 is activated, resetting bar 48 releases relay switches 36, 42 and resets them back to their normal positions 38, 44 respectively.

A second section of the selector switch means is also shown wherein each of the parts are identified by a same numeral as the parts described for the first section but includes a prime designation on each number. Similarly, a second latching network is also interconnected with the second section of the selector switch means and likewise includes a prime designation next to each of its parts which are similarly identified with those parts of the latching network 32 heretofore described.

A source of energy is provided by means of a plug 52 which can be interconnected directly to the AC house current. The AC current is rectified in the bridge rectifier shown generally at 54. Additionally, terminals 56 are provided to interconnect to a battery which can be utilized during possible energy failures and thereby to insure that a source of energy will be provided even during emergencies.

The source of energy is interconnected directly to the input terminal 12 of the first section of the selector switch means 10, and simultaneously along line 58 to each of the relay switches 36, 36'. An alarm circuit shown generally at 60 includes an alarm device 62 in series with a parallel combination of alarm switches 64, 64'. The alarm circuit is interconnected on line 66 to the normal position 38' of the latching relay 32' associated with the second section of the selector switch means. A lamp 68 is connected in parallel with the alarm 62 and control switch 64, and is also connected by line 66 to the terminal 38'.

A third section is included in the selector switch means and comprises similar parts but identified by a double prime. The active terminal 40 of the relay switch 36 is coupled on line 70 to the input terminal 12' of the second section of the selector switch means. Similarly, the active terminal 40' of relay switch 36' is coupled on line 72 to the input terminal 12'' of the third section of the selector switch means. Each of the resetting relay coils 46, 46' are interconnected together and are also interconnected to the "wrong" output terminal 18'' of the third section. The "right" output terminal 16'' of the third section is coupled to a solenoid shown generally at 74 whose other end is coupled to ground.

A number of solenoids 76, 76', 76'' are connected in series with respective control switches 78, 78', 78'' and the series circuits are interconnected with the active position 40' of the switch relay 36'.

The active terminal 47 of the relay switch 42 is coupled to ground and a lamp 80 is coupled in series between the ground terminal, the active position 47, the relay switch 42, the active position 47', the relay switch 42', and the power supply.

Figure 2:
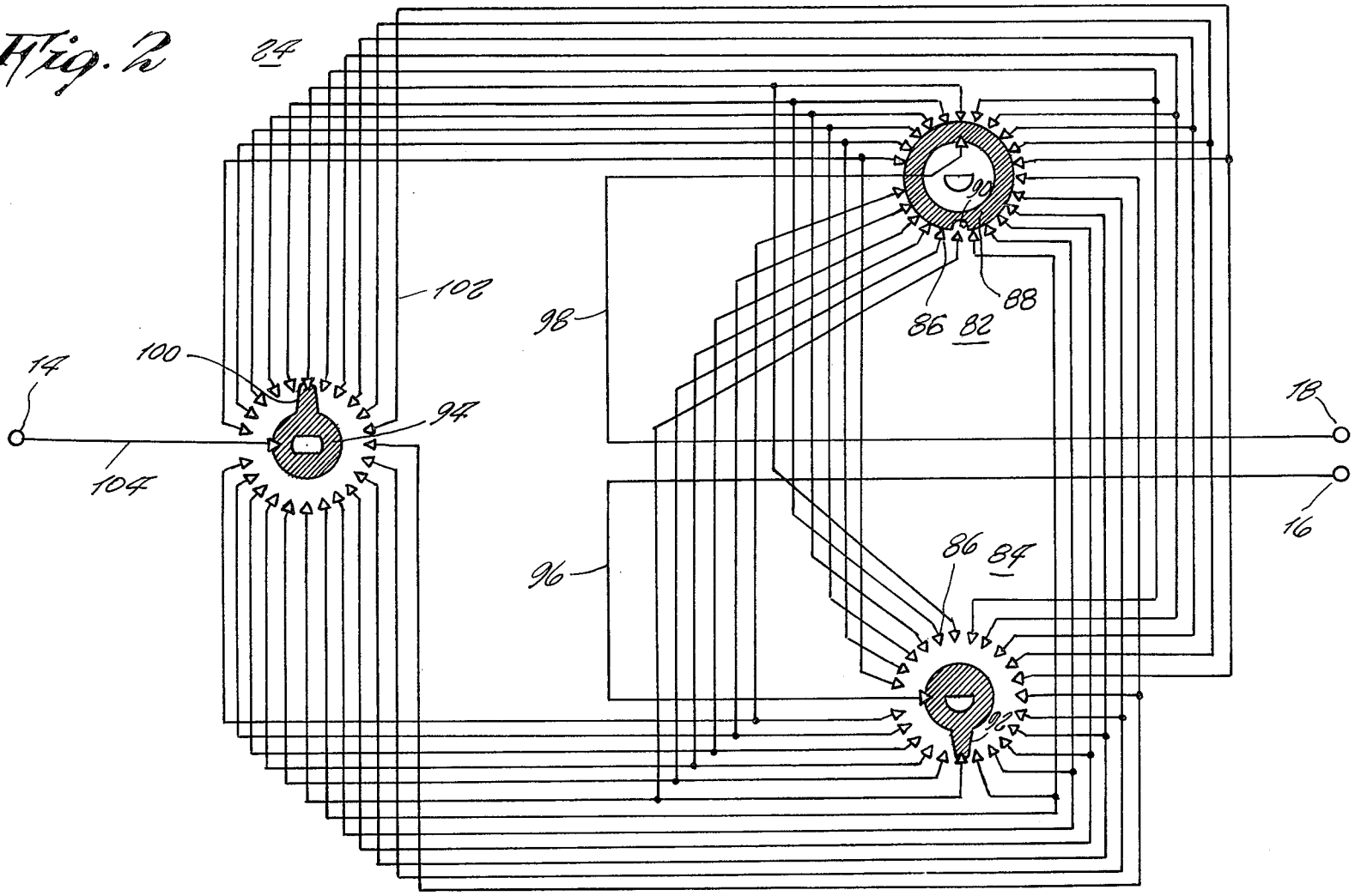
FIG. 2 is a schematic wiring diagram of an embodiment of the rotary dial means utilized in the selector switch.

Referring now to FIG. 2 there is shown one embodiment of one of the switch networks shown generally at 24 and which is interconnected between the intermediate terminal 14 and the right and wrong outputs 16, 18 respectively. A first dial 82 and a second dial 84 are keyed together. Each of these dials have numerous positions 86 around their circumference. The dial 82 includes a conductive ring 88 to which each of the positions 86 are coupled and conductively interconnected. Ring 88 has a notched portion 90 which can be placed adjacent to one of the positions whereby that position will not be conductively interconnected to the ring 88.

Dial 84, on the other hand, only has a single conductive pointing member 92 which can be directed to a single position. Since the two dials 82, 84 are keyed together, the position which dial 84 contacts will be the identical position which the ring 88 does not contact. The right output terminal 16 is coupled by means of wire 96 to the conductive member 92 of the dial 84 and the wrong terminal output 18 is coupled on line 98 to the annular ring 88 of the dial 82.

A control dial 94 contains a conductive finger like member 100 which can be rotated and respectively contacts one of a corresponding plurality of positions. A series of wires, one of which is shown at 102 interconnects each of the positions of dial 94 with the corresponding position on both the dials 82 and 84. The intermediate terminal 14 is coupled to the conductive member 100 of dial 94 by means of the line 104. When the conductive member 100 of dial 94 is placed on the contact position which has been preset on dials 82, 84, that position will be adjacent to the notch 90 on the annular ring 88 of dial 82 and will not contact the annular ring. On the other hand, that position will be contacting the conductive pointer 92 of dial 84 which will interconnect the terminal 14 with the right output terminal 16. For all other positions of the dial 94 the terminal will be interconnected with the annular ring 88 of the dial 82 which will in turn interconnect the intermediate terminal 14 with the wrong output terminal 18. In this manner, the keyed dials 82, 84 can be preset to a desired position, and when the control dial 94 is set to that position a right output will be provided, and for all other positions a wrong output will be provided.

The operation of the embodiment of the invention shown in FIGS. 1 and 2 will now be explained. In its normal guarding position the power supply 54 provides energy on line 58 to the switch 36' which is in its normal position 38' to thereby provide energy to the lamp 68 which, when energized, provides an indication that the system is in a guarding position. The alarm 62 will also be in a guarding position, whereby when any of the doors, windows or the like are opened, switches 64, 64' which are connected to these members, will be automatically closed to thereby sound the alarm. It is understood that the switches 64, 64' would be located at each of the members protecting the premises to be guarded. These switches can be of any well known type which close when the window, door, or the like are opened. The premises are then guarded and protected, and any unauthorized entry will activate the alarm.

When an authorized user desires to enter the premises, the selector switch network 10 which is located exterior to the premises is manipulated to open the combination. The user turns the switch network 24 of the first section to its preset position which interconnects terminal 14 to the right output 16. The first button 20 is then depressed interconnecting the power supply to the right output terminal 16 thereby energizing the relay coil 34. The relay switches 36, 42 are then caused to close onto their active positions 40, 47 respectively and held in place by means of the reset bar 48. In its active position, relay switch 36 now interconnects the power supply with the input terminal 12' of the second section. Switch 42 is now interconnected to the ground terminal. The authorized user then rotates the dial of the second section to the second preset number and pushes the second button. The power supply is now connected to the output right terminal 16' of the second section which now energizes coil 34' of the latching relay 32'. Relay switches 36', 42' are now placed onto their respective active positions 40', 47'. Switch 36' is then no longer connected to its normal position 38' thereby disconnecting the power supply from the alarm circuit 60 to disengage the alarm. At the same time, in its active position 40', the input terminal 12'' of the third section of the selector switch network is now provided with power from the power supply. Additionally, switch 42' in its active position 47' now completes the series circuit energizing the bulb 80 which indicates that the anti-theft system has been properly disengaged and that the door, window, or the like can be opened at will without causing the alarm to sound.

The authorized user then proceeds with the third section and again placed the dial on its proper preset position for the third section, and by depressing the third button 20'' energizes the solenoid 74 which retracts the plunger holding the door, window, or the like, and permits entry into the premises.

In addition to energizing the third network, relay switch 36' when placed in its active position 40' also permits the solenoid 76 to be activated when the control switch 78 is closed. Each of the solenoids 76, 76', 76'' can be connected to a window or other member, such that when the respective control switch 78, 78', 78'' is depressed, the solenoid will be activated to retract the plunger thereby permitting the opening of the window, or other member within the premises.

Should an unauthorized user attempt to open the selector switch means by manipulating the dials and buttons, and he places the dial of any of the sections at a wrong position, when he depresses the respective button, the wrong output will be activated, this will energize the reset coils 46, 46' to thereby cause the reset bar 48, 48' to be energized thereby releasing the relay switches to their normal positions. When switch 36' goes back to its normal position 38' the alarm circuit 60 will be activated.

It is therefore understood that in the embodiment shown in FIGS. 1 and 2, that essentially the selector swtich means has two sections namely the first and second sections. After these two sections have been properly activated, the alarm is disengaged and the circuit is in a state for authorized opening of the doors, windows, and the like. The particular door, window or the like can be controlled either by a simple control button 78 which energizes a solenoid 76, or an additional final section, indicated as section 3, can be utilized and included into the selector switch network in order to open a solenoid 74. However, only the first two sections are the ones which actually disengage the alarm circuit.

Although only two such sections have been shown, it is understood that a plurality of such sections can be included, whereby each of the sections would have its own corresponding latching network. Each latching network would be interconnected to the next succeeding section whereby only after the last section is properly activated will the alarm circuit be disengaged. Furthermore, a plurality of buttons can be utilized wherein each represents a section and for each of the sections the proper position on the dial must be set. Furthermore, the sequence of depressing the buttons can also be preselected. In this manner, there is effectively a double combination lock which is interrelated. Both the particular sequence of buttons must be known, as well as the particular position of the dial corresponding to each button, must likewise be known. The total number of dial positions can also be varied, and a dial with many numbered positions can be utilized to increase the complexity and the number of possible combination. The lamp 80 will only be energized after all of the sections have been properly activated and when the lamp 80 is turned on the aurthorized user will know that he can then open the windows, doors or the like by either depressing the control button 78 or by utilizing an additional section of the selector network as shown in the embodiment as section 3.

Figure 3:
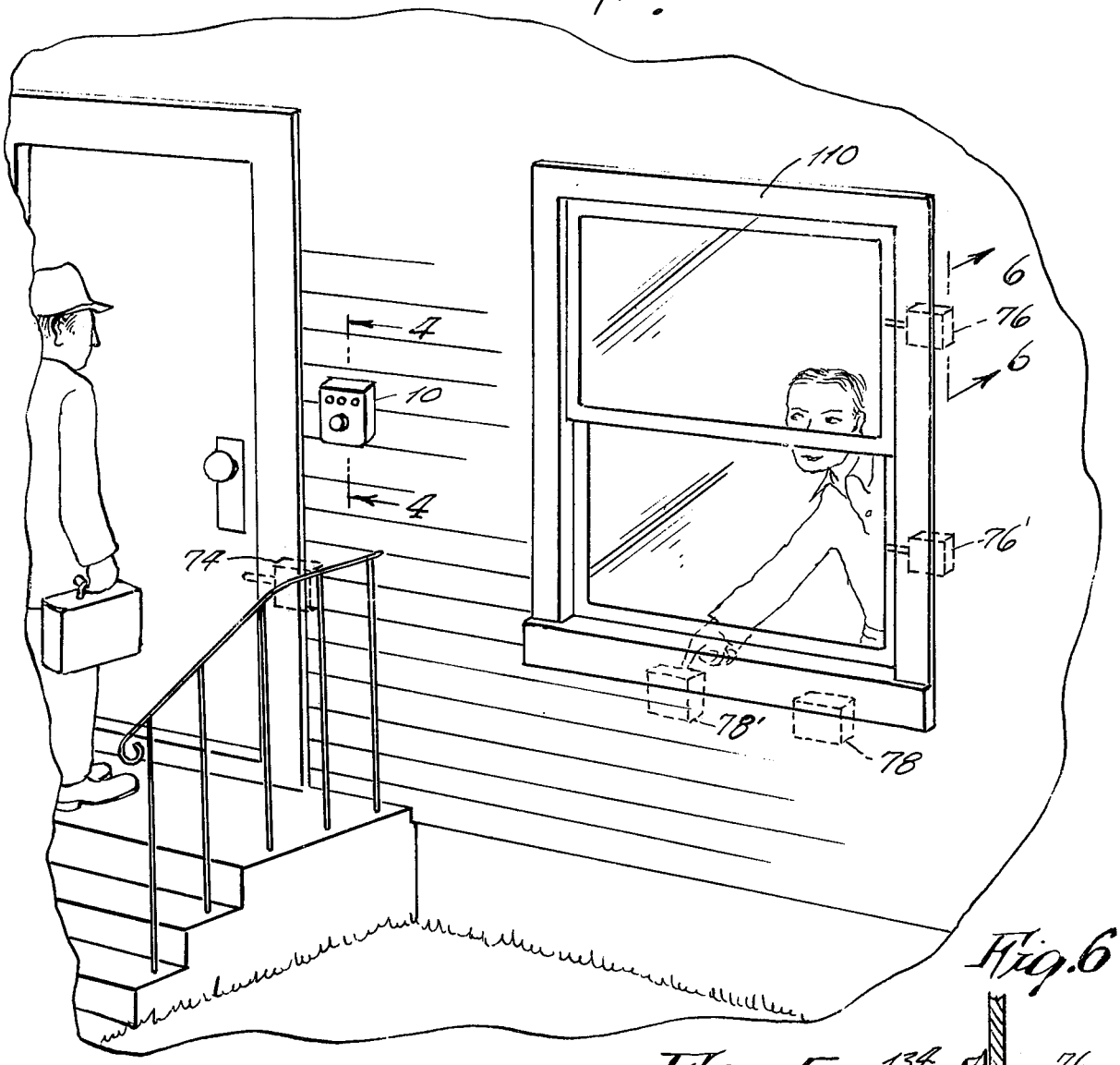
FIG. 3 is a perspective view of an embodiment of the invention, installed for guarding a premises.

Referring now to FIG. 3, it will be shown how the present embodiment of the invention can be utilized to protect a premises. The selector switch network 10 is placed within a housing and located externally to the premises, generally near the door which is to be opened by this network. The solenoid 74 controls the door and by means of its plunger holds the door in a closed position. It is noted that there is no keyhole since in fact no key at all is utilized to gain entry into the premises and such entry can only be attained by means of utilizing the anti-theft entry system of the invention. When the proper sequence of buttons and rotary dial positions are manipulated the solenoid 74 will be retracted and authorized entry can be obtained.

Inside the premises each of the closing members, such as the window, shown generally at 110, will have a solenoid 76 which has its plunger retaining the window in a closed position. A selector switch network 10 can be located inside the premises, and includes the series of buttons and rotary dials. This switch can be manipulated inside the house to open the doors, window and the like. For general use within the house, the selector switch networks will be placed in a position whereby all of its sections can be activated and all that is needed to open a window is to close a switch 78 in order to activate the solenoid. The switches 78, 78′, etc., can be placed near each of the windows, doors, or the like, and when that window, door or the like is to be opened, that switch is closed.

Figure 4:
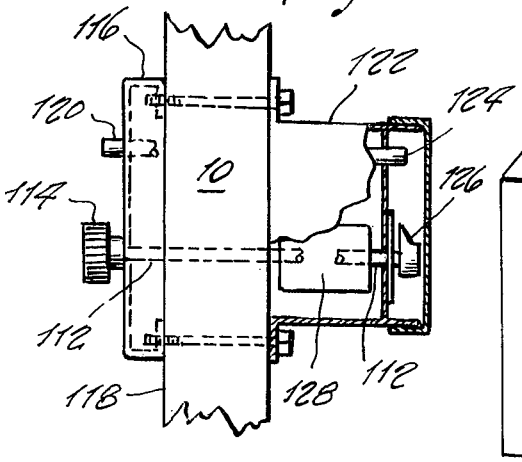
FIG. 4 is a partially sectioned view of the selector switch means and housing taken along line 4—4 of FIG. 3.

Referring now to FIG. 4 there is shown in partly broken away cross section of the selector switch network. It is noted that a single shaft 112 interconnects all of the rotary dials shown in FIG. 2 and a single knob 114 is utilized to rotate the shaft. The housing 116 is placed on the exterior of the premises wall 118 and has the buttons 120 readily available for external manipulation.

Interior of the house, an identical system can be interconnected which includes a housing 122 having the buttons 124 therein. The buttons 124 would be directly interconnected with the buttons 120 so that the operation of either can be effective. In fact, in FIG. 1, such buttons were shown as buttons 20 and 22 wherein it was noted that either of the buttons can be used for the same purpose. The rotary dials can be manipulated inside the house by means of the same shaft 112 coupled to a knob 126 located on the interior portion. The network would be contained within the housing 128. In this manner, only a single network need by utilized wherein it can be controlled either from the exterior of the house or from the interior of the house to control the same door. At the same time, the interior housing can also be utilized to disengage the alarm circuit for the entire household and thereby permit the opening of any of the windows or other members being guarded.

Figure 5:
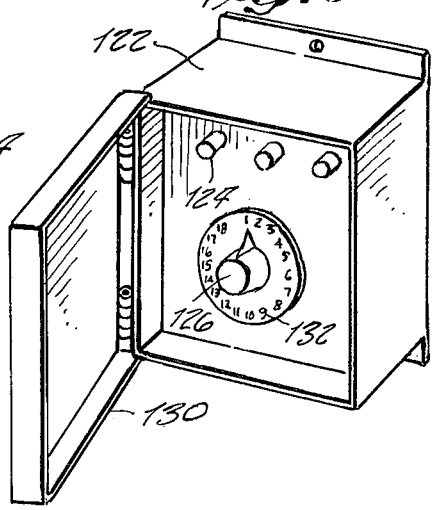
FIG. 5 is a perspective view of an inside housing unit in accordance with an embodiment of the present invention.

Referring now to FIG. 5 there is shown a perspective view of the housing of the interior selector switch means and includes the case 122 and cover 130 to provide protection and beauty. Inside the case there are the buttons 124 available for easy manipulation, as well as the dial knob, and a rotary scale 132 positioned around the knob and containing the positions to which the knob can be rotated. It is noted that a single knob and a single shaft is utilized for all of the rotary dials of all of the sections of the selector switch network.

Figure 6:
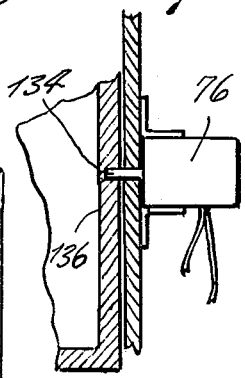
FIG. 6 is a cross-sectional side view taken along line 6—6 of FIG. 3 and showing one of the entry solenoids in accordance with an embodiment of the present invention.

Referring to FIG. 6 there is shown how the solenoid 76 would be utilized with its plunger 134 extending into the frame 136 of a window thereby holding it closed until such time as the solenoid is energized retracting the plunger and permitting the window to be opened.

It is therefore evident that with the aforedescribed embodiments of the present invention the anti-theft system is utilized both as a burglar alarm providing protection against unauthorized entry as well as the usual entry system of the premises, without the use of a key. In most burglar alarm systems, the burglar alarm is complementary to the normal entry system of the house and the normal entry system is by means of a key. In the present invention, there is not provided any key system to enter into the premises and the anti-theft entry system is utilized both for authorized entry into the house as well as a burglar alarm system preventing unauthorized entry. In both cases, the use of a key is avoided. Furthermore, it is noted that the unique type of selector switch means which combines a predetermined sequence of button depressions in conjunction with a dial which must be set at a particular position for each of the buttons being depressed. This provides a great number of variable combinations thereby making it extremely difficult to obtain unauthorized entry into the premises.

There has been disclosed heretofore the best embodiment of the invention presently contemplated. However, it is to be understood that various changes and modifications may be made thereto without departing from the spirit of the invention.

What is claimed is:

1. An anti-theft entry system for guarding a premises comprising:

a. selector switch means having a plurality of sections, each section including: an input terminal, an output terminal, and an intermediate terminal, a rotary dial means coupled between the intermediate terminal and the output terminal, said rotary dial means having a plurality of positions and capable of being preset to interconnect said last two mentioned terminals when dialed to a particular position, button switch means coupled between the input terminal and the intermediate terminal;

b. a plurality of latching means each respectively associated with a section of said selector switch means, each of said latching means including: a relay coil coupled to the output terminal of its respective section and energized when the respective button switch means is closed and the preset position is dialed on its respective rotary dial means, a relay switch activated by said relay coil to close from a normal position to an active position, reset means coupled to the output terminal of its respective section and energized when its respective button switch means is closed and its respective rotary dial means is set to any position other than its preset position, said reset means returning its respective relay switch back to its normal position, the active position of the relay switches of each latching means, with the exclusion of one, being interconnected to the input terminal of a different section of the selector switch means in a predetermined sequence, wherein the excluded relay switch is the last in the sequence;

c. energy supply means coupled to each of said relay switches and also coupled to the input terminal of the remaining section of the selector switch means not interconnected to any active position;

d. alarm circuit means coupled to the normal position of the excluded relay switch; and e. entry means coupled to the active position of the excluded relay switch for releasing a window, door, or the like, whereby when the button switch means are depressed in the predetermined sequence, and for each button being depressed its respective dial means is positioned to its corresponding present position, said alarm circuit will be disengaged and only authorized entry can be obtained into the premises into the premises by entry means.

2. The system as in claim 1 and wherein said entry means comprises an additional final section on said selector switch means, said additional final section having an input terminal, an intermediate terminal, an output terminal, a rotary dial means coupled between the intermediate and the output terminals, said rotary dial means having a plurality of positions and being capable of preset to interconnect said last two mentioned terminals when dialed to a preset position, button switch means coupled between said input terminal and said intermediate terminal, and solenoid means controlling a window, door, or the like, the input terminal of said final section being interconnected to the active position of the excluded relay switch and the output terminal of said final section being interconnected to said solenoid means, whereby after the alarm has been disengaged, depressing of the button on said final section with its corresponding rotary dial means being on its preset position, will energize said solenoid to permit opening of the window, door or the like.

3. The system as in claim 1 and wherein said entry means includes solenoid means and a control switch in series circuit with said solenoid means, said series circuit being interconnected with the active terminal of the excluded relay switch, whereby after the alarm has been disengaged, closing of said control switch energizes said solenoid to permit opening of the window, door, or the like.

4. The system as in claim 1 and wherein all of said reset means are electrically interconnected, whereby when one reset means is energized, all the relay switches are returned to their normal positions.

5. The system as in claim 1 and furter comprising lamp means coupled to said alarm circuit means for indicating when said anti-theft device is guarding the premises.

6. The system as in claim 1 and wherein said alarm circuit means includes an alarm device and at least one alarm switch in series with said alarm device, said alarm switch being coupled to a door, window or the like, and wherein when said alarm switch is activated by an unauthorized entry through the door, window, or the like, said alarm device will be sounded.

7. The system as in claim 1 and further comprising a single selector dial having a shaft coupling each of the plurality of rotary dial means, a knob connected to said shaft, and a rotary scale positioned around said knob, whereby said single selector dial can be used to position all of said rotary dial means.

8. The system as in claim 7 and further comprising exterior housing means containing said single selector dial and said selector switch means, said exterior housing adapted to be mounted externally of the premises being guarded, and wherein said plurality of switch buttons are mounted onto said housing for external manipulation.

9. The system as in claim 8 and further comprising interior housing means including a further selector dial coupled onto the same shaft as said single selector dial, and a further plurality of switch buttons each respectively coupled to one of the first plurality of switch buttons on the exterior housing, and wherein said interior housing is adapted to be mounted internally of the premises being guarded.

10. The system as in claim 1 and further comprising lamp means coupled to each of said latching means and energizing when all said relay switch means are placed in their respective active positions.

* * * * *